US008746372B2

(12) United States Patent
Baugh

(10) Patent No.: US 8,746,372 B2
(45) Date of Patent: Jun. 10, 2014

(54) SHEARABLE DRILL PIPE AND METHOD

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 0 days.

(21) Appl. No.: 14/026,462

(22) Filed: Nov. 13, 2013

(65) Prior Publication Data

US 2014/0054086 A1 Feb. 27, 2014

Related U.S. Application Data

(63) Continuation of application No. 12/806,447, filed on Aug. 13, 2010, now Pat. No. 8,584,775.

(51) Int. Cl.
*E21B 17/00* (2006.01)

(52) U.S. Cl.
USPC ..... 175/320

(58) Field of Classification Search
USPC ..... 175/320, 323, 325.2, 325.3, 232, 294; 138/177, 141, 140, 109; 285/55, 123.1, 285/148.22, 329, 333, 334
See application file for complete search history.

(56) References Cited

U.S. PATENT DOCUMENTS

| | | | |
|---|---|---|---|
| 2,328,856 | A | 9/1943 | Stone |
| 3,047,313 | A | 7/1962 | Bruce |
| 3,167,137 | A | 1/1965 | Humphrey |
| 5,184,495 | A | 2/1993 | Chunn et al. |

*Primary Examiner* — Cathleen Hutchins
*Assistant Examiner* — Ronald Runyan

(57) ABSTRACT

The method of shearing drill collars used in the drilling of oil and gas wells, comprising providing an outer sleeve of a first material for carrying structural loads, providing a second material within the outer sleeve which is lower in shear strength and is greater in unit weight than the first material, and providing a hole in the second material for the circulation of fluids.

14 Claims, 3 Drawing Sheets

SHEARABLE DRILL PIPE AND METHOD

This application is a continuation application of U.S. patent application Ser. No. 12/806,447 filed Aug. 13, 2010.

TECHNICAL FIELD

This invention relates to the method of shearing drill pipe for drilling oil or gas wells, especially in deep water.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The drill bit for drilling oil and gas wells is facilitated by having a heavy load applied to assist in crushing and pulverizing the formation being drilled. The formation material must be reduced to particles small enough that the flow of drilling mud up to the surface will carry it to the surface. Drill collars are connected to the drill bit to provide the heavy load for this purpose.

The drill bit and drill collars are part of a drill string which also includes drill pipe which extends to the drilling rig at the surface.

The drill pipe which extends to the surface is thin walled. Its primary design requirement is to support the weight of the drill string including the drill collars during running and retrieving of the drill string.

Conversely, the drill collars are at the bottom of the drill string and they only support themselves. The drill pipe can be 20,000 feet long or longer and drill collars seldom exceed 1,000 feet in length. Although the drill collars are heavier, there is much more length in drill pipe, and the drill pipe must support the drill collars and the drill pipe.

Drill collars have as small a bore as practical and as large an outer diameter as is practical so that they will be heavy. The drill collars have metal sealing threaded connections on each end. These threaded connections are benefited by being made of high strength steel. As a result the entire drill collar is made of high strength steel. They are extremely strong as a result, but do not have a requirement for being extremely strong. They are characteristically so strong that the average person presumes they need to be strong, because they always are.

A problem resulting from this is that the thick cross section of high strength steel cannot be sheared by the blind shear rams in the primary well control device, the blowout preventer stack. The blind shear rams are to cut the pipe in the bore and seal across the bore to keep a well from blowing out. When as much as 1000 feet of drill collars pass in front of the blind shear rams, the well bore literally cannot be closed.

On land or platform wells this is not a major concern as in unexpected pressure situations there is always a closable valve on the top of the drill string except for the short time for making connections at the surface. For the annular area between the outside diameter of the drill string in the well and the bore of the blowout preventer stack, there are annular and ram type blowout preventers which are well known in the art and can be closed to seal this annular area.

In deepwater drilling situations from a floating vessel the situation is different. In the worst case scenario the vessel can be blown off location or can have a steering computer accidental drive off when you are in an unexpected pressure situation. If this happens when the drill collars are in the bore in front of the blind shear rams, you cannot close the blowout preventers and you cannot let go of the pipe string. In other words you have a blowout.

BRIEF SUMMARY OF THE INVENTION

The object of this invention is to provide a drill collar which can be sheared with conventional blowout preventer shear rams.

A second object of this invention is to provide drill collars of a higher unit weight such that the length of the drill collars to provide a desired weight on the bit will be reduced.

DETAILED DESCRIPTION OF THE INVENTION

Figure 1:
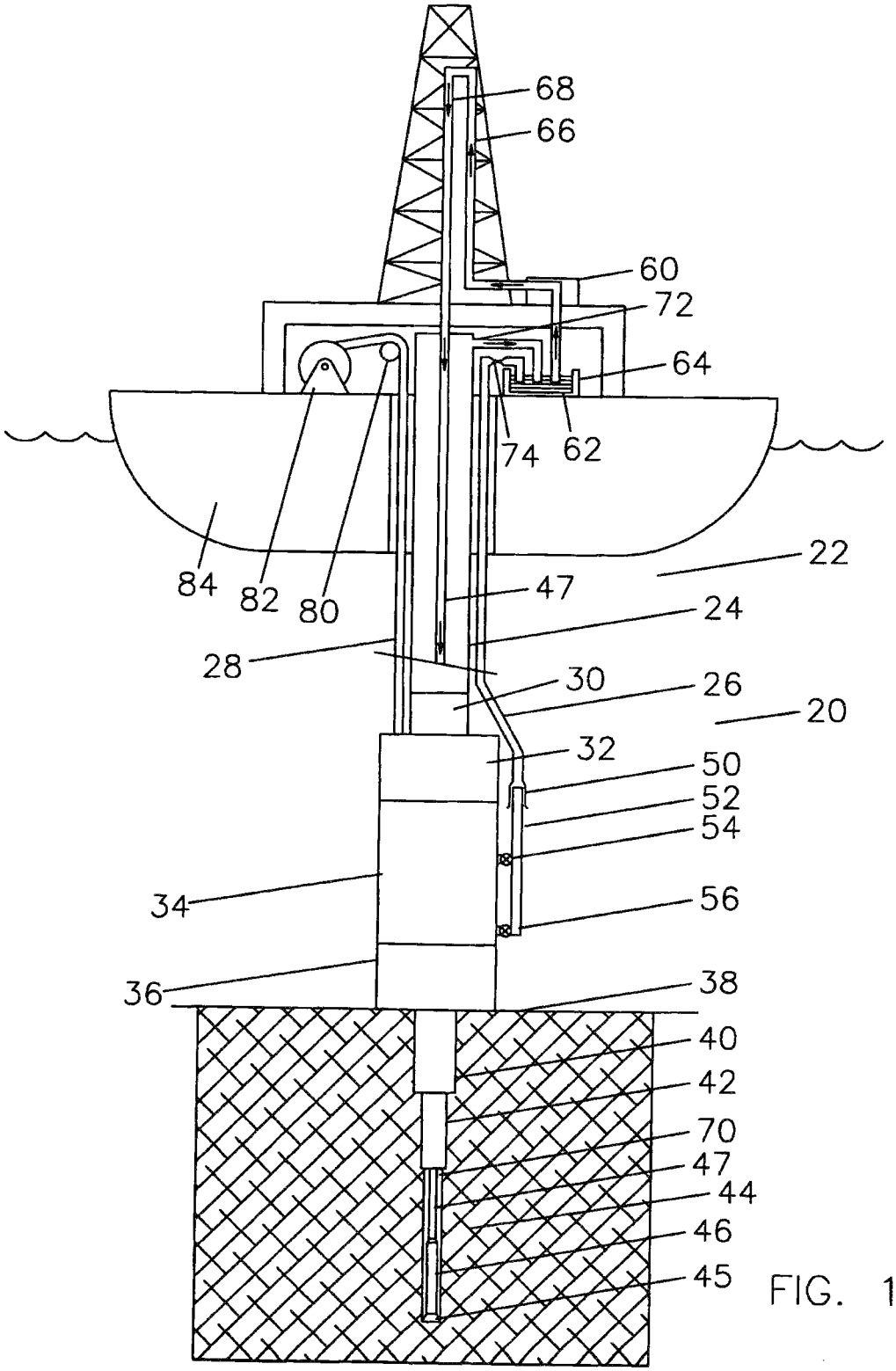
FIG. 1 is a view of a deepwater drilling system using the drill collars of this invention

Referring now to FIG. 1, a view of a complete system for drilling subsea wells 20 is shown in order to illustrate the utility of the present invention. The drilling riser 22 is shown with a central pipe 24, outside fluid lines 26, and control lines 28.

Below the drilling riser 22 is a flex joint 30, lower marine riser package 32, lower blowout preventer stack 34 and wellhead 36 landed on the seafloor 38.

Below the wellhead 36, it can be seen that a hole was drilled for a first casing string, that string 40 was landed and cemented in place, a hole drilled thru the first string for a second string, the second string 42 cemented in place, and a hole is being drilled for a third casing string by drill string 44 which includes drill bit 45, heavy weight drill collars 46, and lighter weight drill pipe 47.

The lower Blowout Preventer stack 34 generally comprises a lower hydraulic connector for connecting to the subsea wellhead system 36, usually 4 or 5 ram style Blowout Preventers, an annular preventer, and an upper mandrel for connection by the connector on the lower marine riser package 32.

Below outside fluid line 26 is a choke and kill (C&K) connector 50 and a pipe 52 which is generally illustrative of a choke or kill line. Pipe 52 goes down to valves 54 and 56 which provide flow to or from the central bore of the blowout preventer stack as may be appropriate from time to time. Typically a kill line will enter the bore of the Blowout Preventers below the lowest ram and has the general function of pumping heavy fluid to the well to overburden the pressure in the bore or to "kill" the pressure. The general implication of this is that the heavier mud will not be circulated, but rather forced into the formations. A choke line will typically enter the well bore above the lowest ram and is generally intended to allow circulation to circulate heavier mud into the well to regain pressure control of the well.

Normal drilling circulation is the mud pumps 60 taking drilling mud 62 from tank 64. The drilling mud will be pumped up a standpipe 66 and down the upper end 68 of the drill pipe 47. It will be pumped down the drill pipe 47, out the drill bit 45, and return up the annular area 70 between the outside of the drill pipe 47 and the bore of the hole being drilled, up the bore of the casing 42, through the subsea wellhead system 36, the lower blowout preventer stack 34, the lower marine riser package 32, up the drilling riser 24, out a bell nipple 72 and back into the mud tank 64.

During situations in which an abnormally high pressure from the formation has entered the well bore, the thin walled central pipe 24 is typically not able to withstand the pressures involved. Rather than making the wall thickness of the relatively large bore drilling riser thick enough to withstand the pressure, the flow is diverted to a choke line 26. It is more economic to have a relatively thick wall in a small pipe to withstand the higher pressures than to have the proportionately thick wall in the larger riser pipe.

When higher pressures are to be contained, one of the annular or ram Blowout Preventers are closed around the drill pipe and the flow coming up the annular area around the drill pipe is diverted out through choke valve 54 into the pipe 52. The flow passes up through C&K connector 50, up pipe 26 which is attached to the outer diameter of the riser 24, through choking means illustrated at 74, and back into the mud tanks 64.

On the opposite side of the drilling riser 24 is shown a cable or hose 28 coming across a sheave 80 from a reel 82 on the vessel 84. The cable 28 is shown characteristically entering the top of the lower marine riser package 32. These cables typically carry hydraulic, electrical, multiplex electrical, or fiber optic signals. Typically there are at least two of these systems, which are characteristically painted yellow and blue. As the cables or hoses 28 enter the top of the lower marine riser package 32, they typically enter the top of the control pod to deliver their supply or signals. When hydraulic supply is delivered, a series of accumulators are located on the lower marine riser package 32 or the lower Blowout Preventer stack 34 to store hydraulic fluid under pressure until needed.

Figure 2:
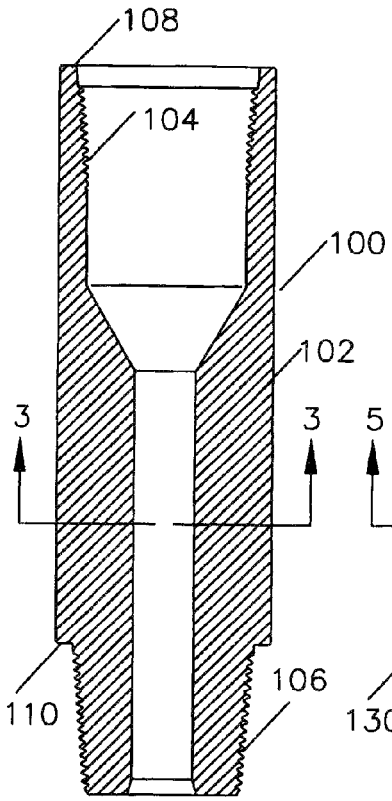
FIG. 2 is a half section of a drill collar of conventional design.

Referring now to FIG. 2, conventional drill collar 100 comprises a central thick wall section 102, an upper female thread 104, a lower male thread 106, an upper sealing shoulder 108 and a lower sealing shoulder 110.

Figure 3:
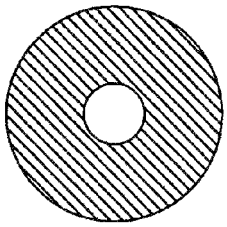
FIG. 3 is a cross section of the drill collar of FIG. 2 taken along lines "3-3".

Referring now to FIG. 3, a cross section of FIG. 2 is shown along lines "3-3" showing the thick cross section required to be sheared.

Figure 4:
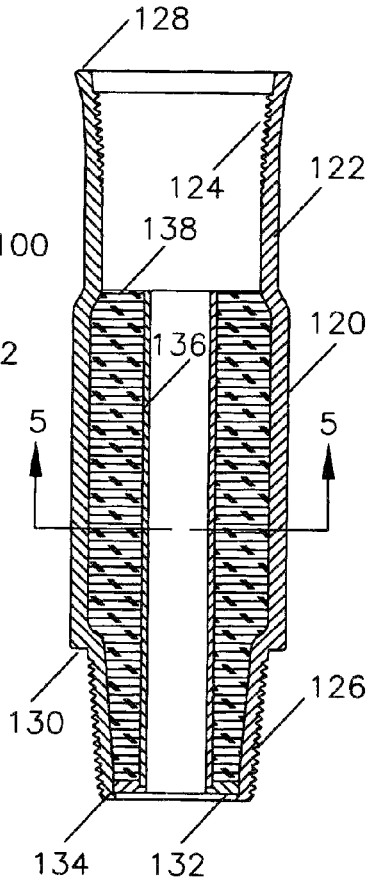
FIG. 4 is a half section of a drill collar of this invention.

Referring now to FIG. 4, a half section of the drill collar 120 of the present invention is shown being made of a thin wall formed tube 122 with an upper thread 124, a lower thread 126, upper sealing shoulder 128 and lower sealing shoulder 130. Ring 132 lands on shoulder 134 and supports thin walled tube 136. Heavy weight material such as lead 138 is melted and poured into the area between tube 122 and thin walled tube 136.

Figure 5:
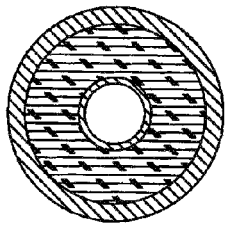
FIG. 5 is a cross section of the drill collar of FIG. 4 taken along lines "5-5".

Referring now to FIG. 5, a cross section of FIG. 4 is shown along lines "5-5" showing the majority of the section required to be sheared is of the lower shear strength material such as lead. As the density of steel is 0.283 lbs. per cubic inch and the density of lead is 0.410 lbs. per cubic inch, lead is approximately 45% heavier than steel. This means that the length of the drill collars of this invention could be up to 45% shorter than conventional drill collars.

Figure 6:
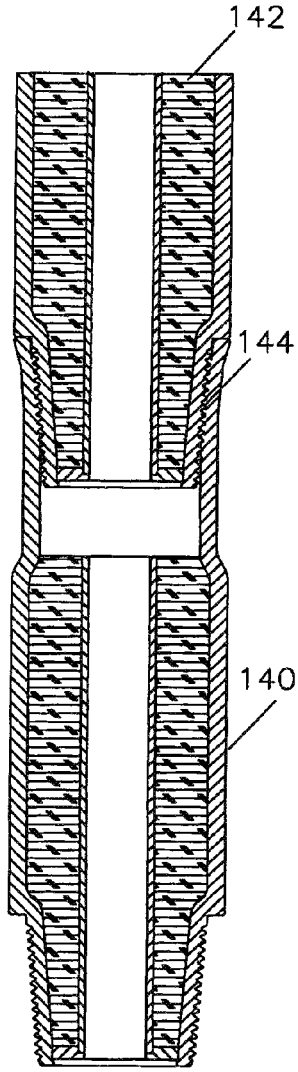
FIG. 6 is a half section of one and one half drill collars of this invention

Referring now to FIG. 6, a drill collar 140 of this invention is shown with a portion of a second drill collar 142 attached at thread 144. This illustrates that even the connection of the drill collar of this invention has a smaller cross section of steel than that of a conventional drill collar such as is shown in FIG. 2.

Figures 7, 8, 9, 10, 11:
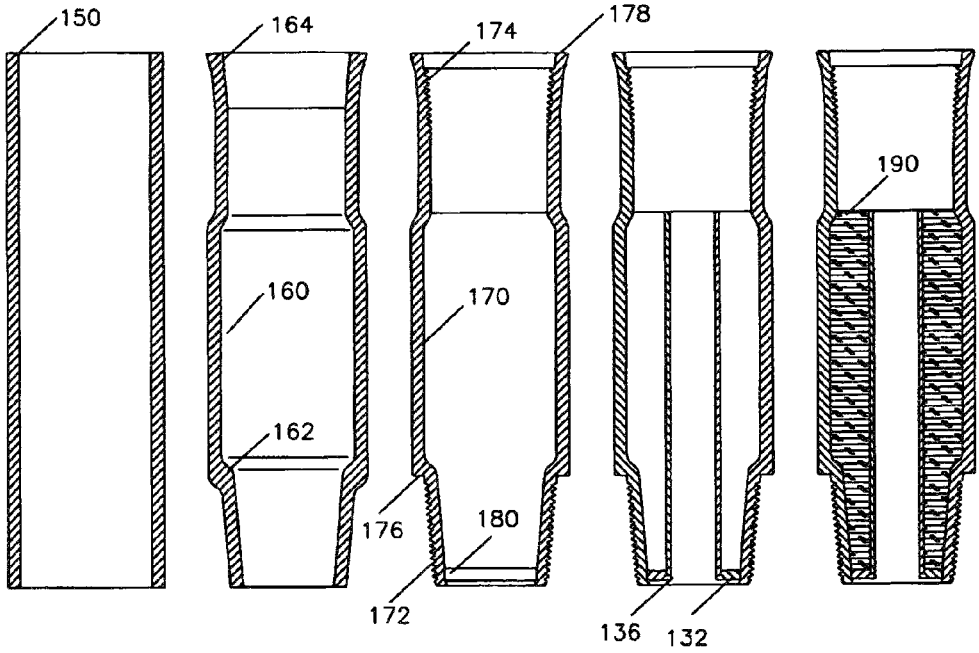
FIG. 7 is a half section of a cylindrical tube which might be used to manufacture the drill collar of this invention.
FIG. 8 is a half section of the tube of FIG. 7 which is rolled and forged to an appropriate shape.
FIG. 9 is a half section of the tube of FIG. 8 machined.
FIG. 10 is a half section of the tube of FIG. 9 with a spacer ring added to the bottom and an internal tube added.
FIG. 11 is a half section of weight material added to the components of FIG. 10.

Referring now to FIG. 7, a simple thin wall tube 150 is shown which can be used as material for a portion of the drill collar of the present invention.

Referring now to FIG. 8, tube 150 of FIG. 7 is rolled tube 160 to a suitable profile, with some forging upset occurring at locations 162 and 164 where thicker cross sections will be beneficial for machining. This is especially important when the connections are tapered threads.

Referring now to FIG. 9, is shown with the rolled tube 160 of FIG. 8 is a machined tube 170 with a lower thread 172, an upper thread 174, a lower sealing shoulder 176, an upper sealing shoulder 178, and an internal shoulder 180.

Referring now to FIG. 10, machined tube 170 has ring 132 and thin walled tube 136 installed.

Referring now to FIG. 11, lead 190 is poured into the assembly of FIG. 10 and allowed to solidify. As lead tends to shrink when solidifying, percentages of bismuth, antimony, and tin can be added to eliminate the shrinkage or to cause a slight expansion if desired. Alternately, a temporary tube can be placed in the bore for molding and then be removed.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. The method of providing a plurality of shearing drill collars used in the drilling of oil and gas wells, comprising:

providing a first drill collar with a first drill collar outer sleeve comprising a first drill collar first material for carrying structural loads, providing said first drill collar with a first drill collar second material within said first drill collar outer sleeve which is lower in shear strength and is greater in unit weight than said first drill collar first material, and providing a hole in said first drill collar second material for the circulation of fluids, said first drill collar outer sleeve comprising a maximum wall thickness smaller than a maximum wall thickness of said first drill collar second material, further providing first drill collar threads on said first drill collar outer sleeve;

providing a second drill collar with a second drill collar outer sleeve comprising a second drill collar first material for carrying structural loads, providing said second drill collar with a second drill collar second material within said second drill collar outer sleeve which is lower in shear strength and is greater in unit weight than said second drill collar first material, and providing a hole in said second drill collar second material for the circulation of fluids, said second drill collar outer sleeve comprising a maximum wall thickness smaller than a maximum wall thickness of said second drill collar second material, further providing second drill collar threads on said second drill collar outer sleeve;

providing that said first drill collar threads on said first drill collar outer sleeve connect with said second drill collar threads on said second drill collar outer sleeve.

2. The method of claim 1 further comprising providing that said first drill collar threads comprise male threads.

3. The method of claim 2 further comprising providing a sealing shoulder on an external surface of said first drill collar outer sleeve proximate said first drill collar threads.

4. The method of claim 2 further comprising increasing a portion of said first drill collar outer sleeve to increase said wall thickness thereof adjacent said first drill collar threads while remaining smaller than said maximum wall thickness of said first drill collar second material.

5. The method of claim 1 wherein a maximum cutting force is limited to cutting through both said first drill collar outer sleeve and said second drill collar outer sleeve at a threaded connection between said first drill collar and said second drill collar.

6. The method of claim 1 further comprising adding an internal tube in each of said first drill collar outer sleeve and said second drill collar outer sleeve.

7. The method of providing shearing drill collars used in the drilling of oil and gas wells which is shearable by a BOP shearing mechanism, comprising: providing a first shearing drill collar with a first outer sleeve for carrying structural loads, providing a first core material tubular within said first outer sleeve which is lower in shear strength and is greater in unit weight than said first outer sleeve, providing a second shearing drill collar with a second outer sleeve for carrying structural loads, providing a threaded connection for connecting between said first drilling collar and said second drilling collar, providing a second core material tubular within said second outer sleeve, providing that a maximum wall diameter of said first outer sleeve is less than said a maximum wall diameter of said first core material tubular, providing that a maximum wall diameter of said second outer sleeve is less than a maximum diameter of said second core material tubular, and providing that a maximum shear resistance which would be encountered by said BOP shearing mechanism along a length of said first shearing drill collar and said second shearing drill collar and said threaded connection is limited to a combination of said first and second outer sleeves.

8. The method of claim 7 wherein said first core material tubular is comprised of the same or substantially the same material as said second core material tubular.

9. The method of providing a shearing drill collar used in the drilling of oil and gas wells, comprising: providing an outer sleeve of a first material for carrying structural loads, providing a second material within said outer sleeve which is lower in shear strength and is greater in unit weight than said first material, providing that for said shearing drill collar that said first material of said outer sleeve comprises a maximum shear strength material encountered by a shearing mechanism along an entire length of said shearing drill collar, providing a hole in said second material for the circulation of fluids, and providing a male threaded connection on one end of said outer sleeve and a female threaded connection on an opposite end of said outer sleeve.

10. A shearing drill collar used in the drilling of oil and gas wells, comprising:

an outer sleeve of a first material for carrying structural loads that extends along an entire length of said shearing drill collar, said outer sleeve comprising an outer sleeve maximum wall thickness;

an inner tubular comprising a second material positioned within said outer sleeve which is lower in shear strength and is greater in unit weight than said first material, said inner tubular comprising an inner tubular maximum wall thickness that is greater than said outer sleeve maximum wall thickness;

a hole in said second material for the circulation of fluids; and a male threaded connection formed on said outer sleeve.

11. The shearing drill collar of claim 10, further comprising said outer sleeve comprising a substantially constant thickness along an entire length of said outer sleeve.

12. The shearing drill collar of claim 10, further comprising a female threaded connection on an opposite end of said outer sleeve from said male threaded connection.

13. The shearing collar of claim 12, further comprising said inner tubular extending at least an entire length between a beginning of said male threaded connection and a beginning of said female threaded connection.

14. The shearing collar of claim 12, wherein said inner tubular is at least partially positioned within said male threaded connection.

* * * * *